United States Patent [19]

Wood

[11] 4,278,168

[45] Jul. 14, 1981

[54] ARTICLE CARRIER AND BLANK THEREFOR

[75] Inventor: Prentice J. Wood, Hapeville, Ga.

[73] Assignee: The Mead Corporation, Dayton, Ohio

[21] Appl. No.: 129,090

[22] Filed: Mar. 10, 1980

[51] Int. Cl.[3] ..... B65D 75/00; B65D 75/06; B65D 75/56

[52] U.S. Cl. ..... 206/183; 206/193; 206/427; 229/52 BC; 229/28 BC

[58] Field of Search ..... 206/199, 183, 193, 194, 206/198, 427; 229/28 BC, 52 BC

[56] References Cited

U.S. PATENT DOCUMENTS

| | | | |
|---|---|---|---|
| 2,529,675 | 11/1950 | Brulin | 206/193 |
| 2,712,882 | 7/1955 | Buttery et al. | 206/183 |
| 2,747,785 | 5/1956 | Fink | 206/183 |
| 3,747,801 | 7/1973 | Graser | 206/193 |
| 4,103,770 | 8/1978 | Bandenburger et al. | 206/193 |

*Primary Examiner*—William T. Dixson, Jr.
*Attorney, Agent, or Firm*—Rodgers & Rodgers

[57] ABSTRACT

An article carrier formed from a unitary blank and comprising a bottom wall, side wall means secured to the side edges of the bottom wall, a pair of end walls secured respectively to the ends of the bottom wall and secured to the ends of the side wall means, a top panel secured to the upper edges of the side wall means and the end walls, a supplementary bottom panel secured to an end edge of the bottom wall and disposed in overlying relationship therewith, handle means secured to the secondary bottom panel and upstanding therefrom and forming a medial partition, the top panel being removable with at least one V-shaped bend line formed therein, and the handle means being inter-connected with one of the end walls.

23 Claims, 11 Drawing Figures

ARTICLE CARRIER AND BLANK THEREFOR

TECHNICAL FIELD

This invention relates to article carriers which are especially strong and well adapted for use in connection with returnable primary packages.

BACKGROUND ART

Historically the basket style article carrier has been utilized in connection with returnable articles such as bottles. More recently the fully enclosed type carrier has been adopted for use with returnable articles. An example of this type of carrier is disclosed and claimed in U.S. patent application Ser. No. 109,768 filed Jan. 7, 1980 and which is owned by the assignee of this invention. U.S. Pat. No. Re. 29,063 discloses an enclosed returnable carrier which, unlike the present invention, is of the wraparound type and U.S. Pat. No. 3,090,520 discloses a side loading carrier which is not well adapted for use as a returnable carrier.

DISCLOSURE OF INVENTION

According to this invention in one form, an article carrier is provided and comprises a bottom wall with side wall means and end walls upstanding therefrom, and interconnected with each other at adjacent ends, a top panel secured to the upper edges of the side wall means and the end walls, at least a portion of the top panel being removable, a supplementary bottom panel secured to an end edge of the bottom wall, and handle means joined to the supplementary bottom panel and interconnected with one of the end walls, the handle means also forming a medial partition for the carrier.

BEST MODE FOR CARRYING OUT THE INVENTION

Figure 3:
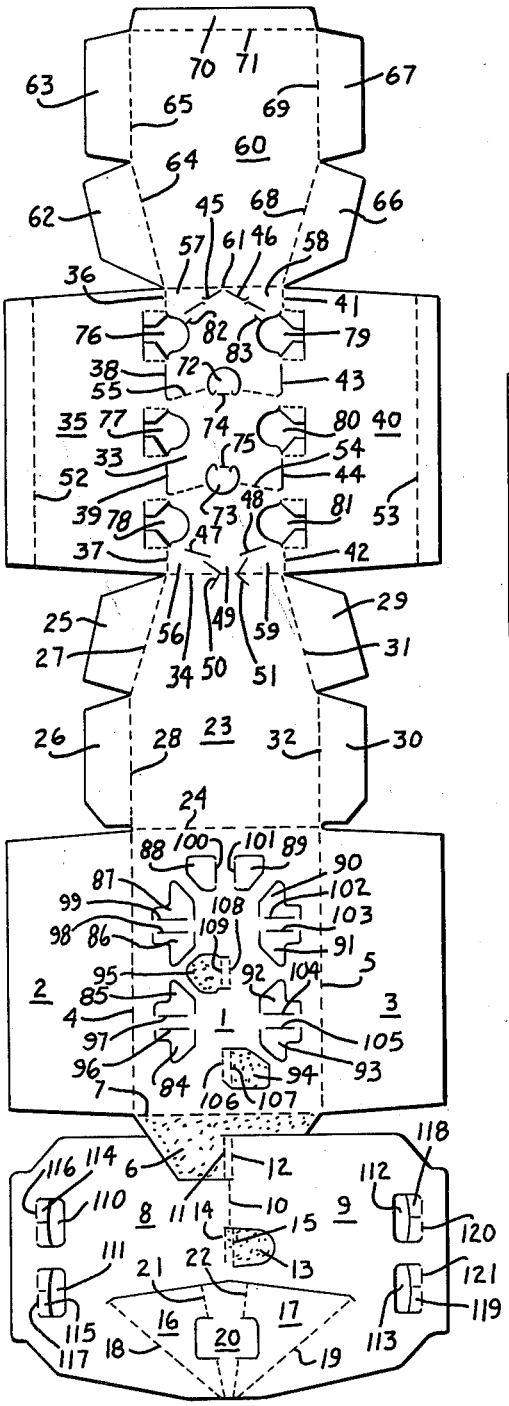
FIG. 3 is a plan view of the blank from which the carrier is formed.

With reference to the drawings and with particular reference to FIG. 3, the numeral 1 designates the bottom wall of the carrier. Lower side wall panels 2 and 3, forming a portion of the carrier side wall means, and foldably joined along fold lines 4 and 5 respectively to the side edges of bottom wall 1. To one end edge of bottom wall 1, supplementary bottom panel 6 is foldably joined along fold line 7.

Handle means for the carrier is provided in the form of handle panels 8 and 9 which are foldably joined together along fold line 10. In addition handle panel 9 is joined to supplementary bottom panel 6 along spaced paralle fold lines 11 and 12. Fastening tab 13 is struck from handle panel 9 and is joined to handle panel 8 along spaced parallel fold lines 14 and 15. Connecting panels 16 and 17 are struck from the handle means and are foldably joined respectively to handle panels 8 and 9 along diagonal fold lines 18 and 19.

Anchoring tab 20 is also struck from handle means and is formed intermediate connecting panels 16 and 17 and is foldably joined thereto respectively along interrupted fold lines 21 and 22. Although two handle panels are shown in the drawings, the handle means formed according to this invention can also comprise only one handle panel in which case either connecting panel 16 or 17 would be omitted as is obvious.

To the other end edge of bottom wall 1, end wall 23 is foldably joined along fold line 24. In addition flaps 25 and 26 are foldably joined respectively to end wall 23 along fold lines 27 and 28. Similarly flaps 29 and 30 are foldably joined respectively to end wall 23 along fold lines 31 and 32.

Top panel or top wall 33 is foldably joined to the upper edge of end wall 23 along interrupted fold line 34. Carrier side wall means includes upper side wall panel 35 which is joined to top panel 33 along fold lines 36 and 37 as well as along weakened severence lines 38 and 39 and upper side panel 40 which is joined to top panel 33 along fold lines 41 and 42 as well as along weakened severance lines 43 and 44. Also weakened severance lines 45 and 46 are formed in top panel 33 at one end thereof and similar severance lines 47 and 48 are formed in top panel 33 at the other end thereof.

In order to facilitate opening of the carrier, thumb tab 49 is formed in top panel 33 and, adjacent to thumb tab 49, cut lines 50 and 51 are formed in the upper portion of end wall 23. In order to facilitate gluing of the carrier, fold lines 52 and 53 are formed respectively in upper side wall panels 35 and 40.

In addition V-shaped bend lines 54 and 55 as well as corner sections 56, 57, 58 and 59 are formed in top panel 33. These features are described in detail in U.S. patent application Ser. No. 109,768 filed Jan. 7, 1980.

To complete the basic elements of the blank, end wall 60 is foldably joined to an end edge of top panel 33 along fold line 61. Flaps 62 and 63 are foldably joined respectively to end wall 60 along fold lines 64 and 65. Likewise flaps 66 and 67 are foldably joined respectively to end wall 60 along fold lines 68 and 69. In addition glue flap 70 is joined to end wall 60 along fold line 71.

For the purpose of facilitating transport of the carrier, finger gripping apertures 72 and 73 are formed in top panel 33 and are foldably joined respectively thereto along fold lines 74 and 75. To receive the necks of the packaged articles, neck receiving apertures 76–81 are provided. For the purpose of insuring proper tearing of top panel 33, slits 82 and 83 are formed respectively on the periphery of neck receiving apertures 76 and 79.

To properly cushion and separate the heels of adjacent articles, cushioning tabs 84–95 are struck from bottom wall 1. Cushioning tabs 84–93 are foldably joined respectively to bottom wall 1 along fold lines 96–105. In addition cushioning tab 94 is joined to bottom wall 1 along parallel spaced fold lines 106 and 107 and, likewise, cushioning tab 95 is joined to bottom wall 1 along parallel spaced fold lines 108 and 109.

Finger gripping apertures 110 and 111 are formed in handle panel 8 and, similarly, finger gripping apertures 112 and 113 are formed in handle panel 9. Also cushioning flaps 114 and 115 are foldably joined respectively to handle panel 8 along fold lines 116 and 117. In like fashion, cushioning flaps 118 and 119 are foldably joined respectively to handle panel 9 along fold lines 120 and 121.

In order to form the carrier from the blank shown in FIG. 3, initially it is necessary to make an application of glue to supplementary bottom panel 6, cushioning tabs 94 and 95 and fastening tab 13 as shown by stippling in FIG. 3. Then supplementary bottom panel 6 together with handle panels 8 and 9 and the associated structure are elevated and folded over along fold line 7 to occupy the positions shown in FIG. 4. By this operation, supplementary bottom panel 6 and fastening tab 13 are adhered to the upper surface of bottom wall 1. Also cushioning tabs 94 and 95 are adhered respectively to handle panels 9 and 8.

Figure 4:
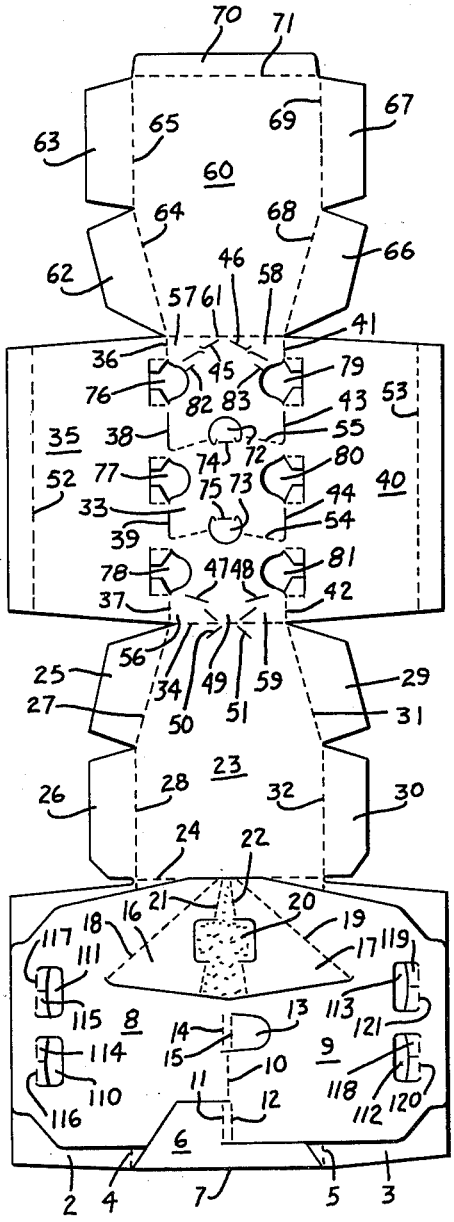
FIGS. 4 and 5 depict intermediate stages through which the blank shown in FIG. 3 is manipulated and glued in order to form a complete and collapsed carrier as shown in FIG. 6.

Following this operation, an application of glue is made to the exposed surface of anchoring tab 20 as shown by stippling in FIG. 4. Then bottom wall 1 together with supplementary bottom panel 6 and handle panels 8 and 9 are all elevated and folded over along fold line 24 to occupy the positions shown in FIG. 5. Anchoring tab 20 is then adhered to the inner surface of end wall 23.

Figure 5:
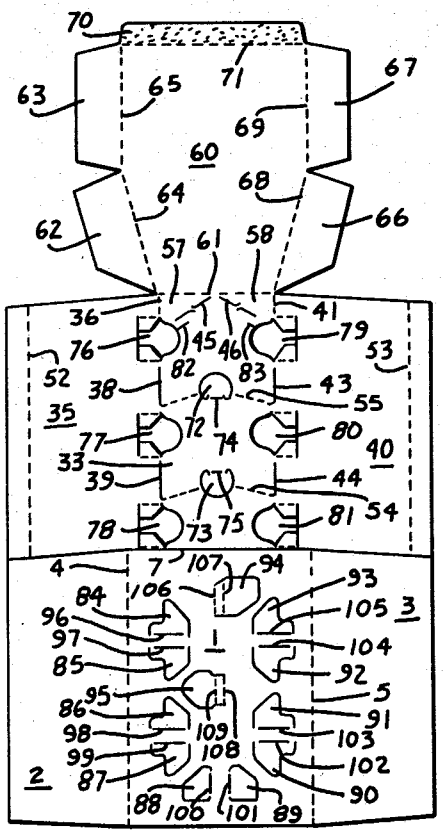

Then an application of glue is made to glue flap 70 as shown by stippling in FIG. 5. Thereafter end wall 60 and the associated structure are elevated and folded over along field line 61 to occupy the positions shown in FIG. 6. By this operation, glue flap 70 is adhered to bottom wall 1.

Figure 6:
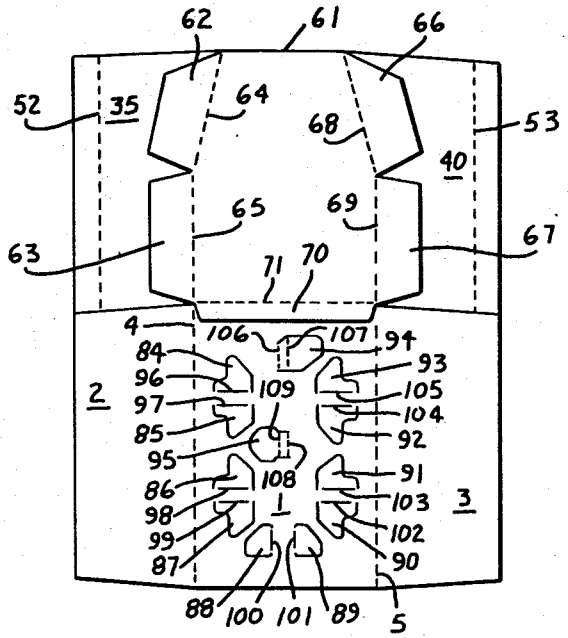
Figure 7:
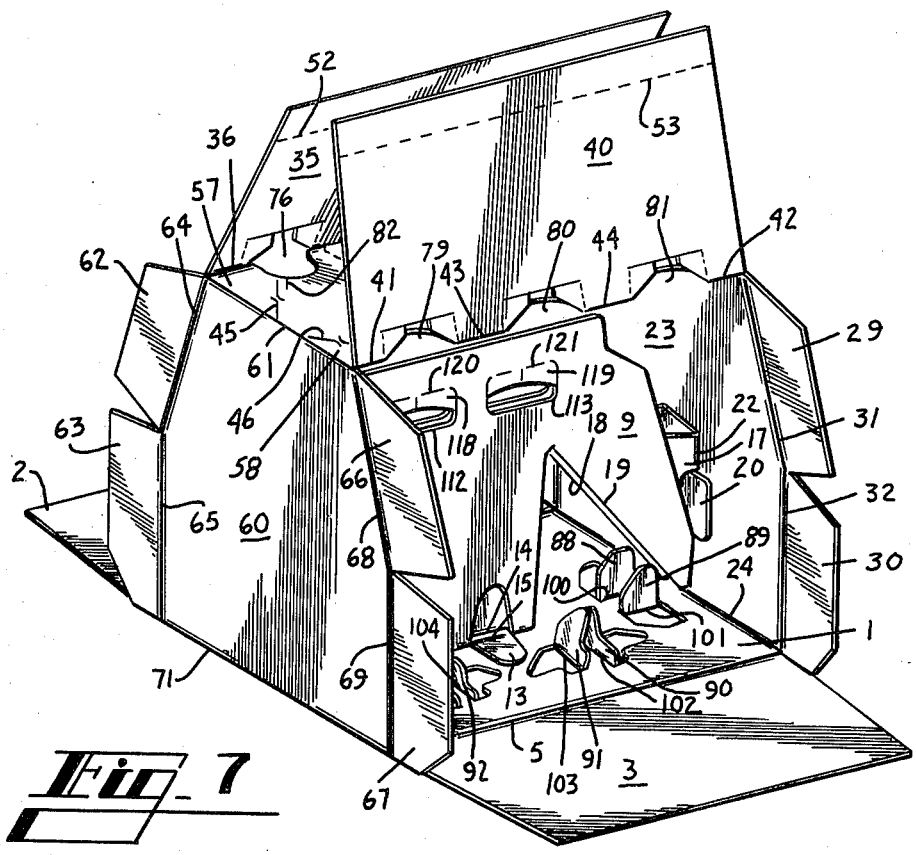
FIG. 7 is an isometric view of the carrier disposed in a condition appropriate for loading the articles through the open sides thereof.
Figure 8:
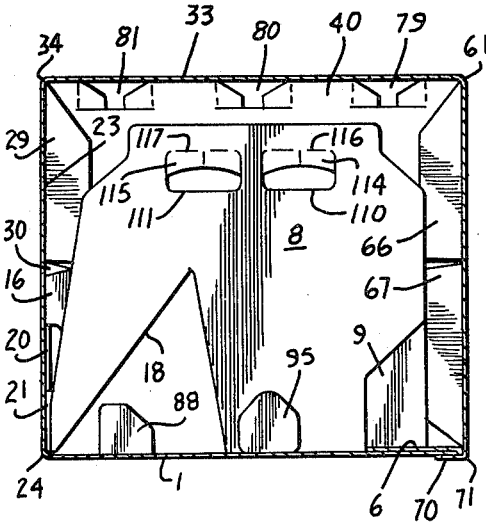
FIG. 8 is a side view taken along the line 8—8 in FIG. 1.
Figure 9:
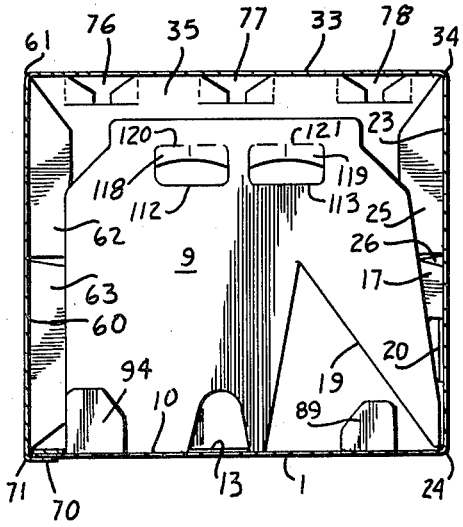
FIG. 9 is a side view taken along the line 9—9 in FIG. 1.

In order to set up the carrier from the collapsed condition shown in FIG. 6, it is simple necessary to manipulate the blank into a position whereby the end walls are parallel to each other and whereby the top panel and bottom wall are also parallel to each other. Simultaneously with this, handle panels 8 and 9 and cushioning tabs 94 and 95 are pulled upwardly automatically into vertical positions by connecting panels 16 and 17 and anchoring tab 20 whereby they are disposed substantially perpendicular to bottom wall 1 and in overlapping relationship respectively with connecting panels 16 and 17. Also cushioning tabs 84–93 are elevated into vertical positions. Cushioning tabs 88 and 89 in effect fill the void formed by connecting panels 16 and 17 when set up. Then upper side wall panels 35 and 40 are swung upwardly into substantially vertical positions and lower side wall panels 2 and 3 are manipulated into horizontal positions. The carrier then appears as shown in FIG. 7 and is in condition for loading through its sides.

Figure 1:
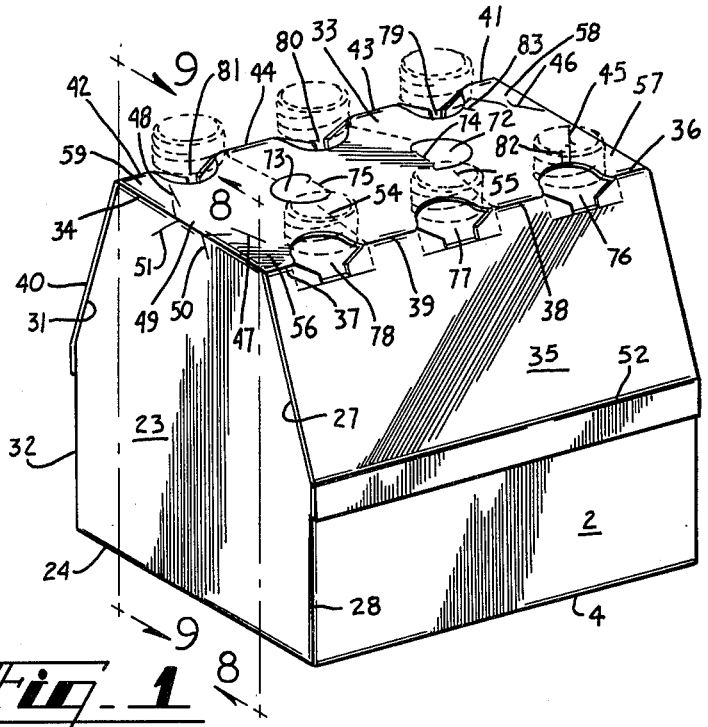
FIG. 1 is an isometric view of an article carrier formed according to this invention.

In order to load the carrier, articles are guided into the article cells from both sides by means of appropriate article loading machinery. Subsequent to this flaps 25, 26, 29, 30, 62, 63, 66 and 67 are swung inwardly of the carrier and glue is applied to flaps 26, 30, 63 and 67. Thereafter lower side wall panels 2 and 3 are elevated and secured to the associated flaps. Then upper side wall panels 35 and 40 are lowered and, generally simultaneously with this operation, the ends thereof are rotated outwardly approximately 180° along fold lines 52 and 53 respectively. Glue is then applied to the exposed end portions of upper side wall panels 35 and 40 which are then rotated into a glued relationship with the respective lower side wall panels 2 and 3. The carrier then appears as shown in FIG. 1.

Figure 2:
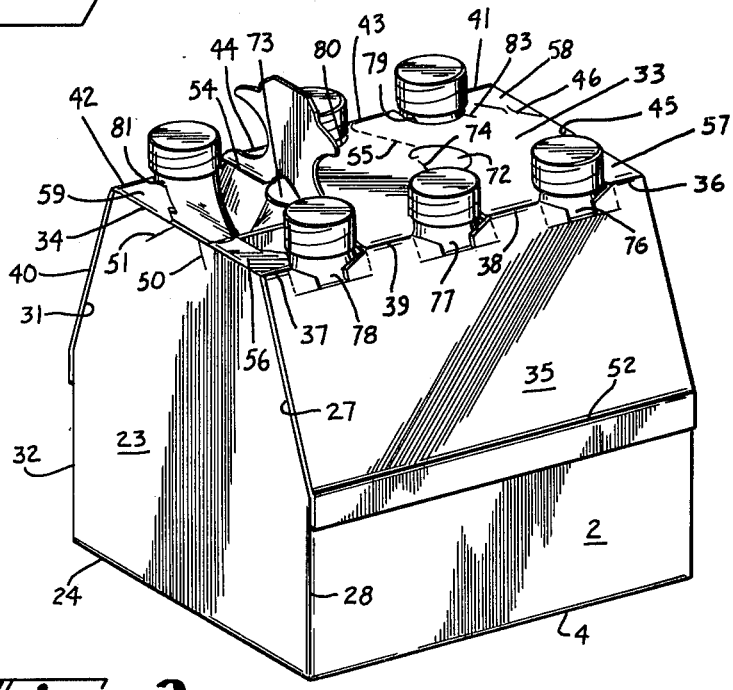
FIG. 2 is an isometric view of the carrier with a portion of the top panel partially removed.

In order to open the carrier for removal of the packaged articles, it is simply necessary to grasp thumb tab 49 and to pull top panel 33 upwardly as shown in FIG. 2. By this operation the inner portion of top panel 33 is severed along weakened severance lines 47, 48, 39, 44, 38, 43, 45 and 46 and slits 82 and 83.

Figure 11:
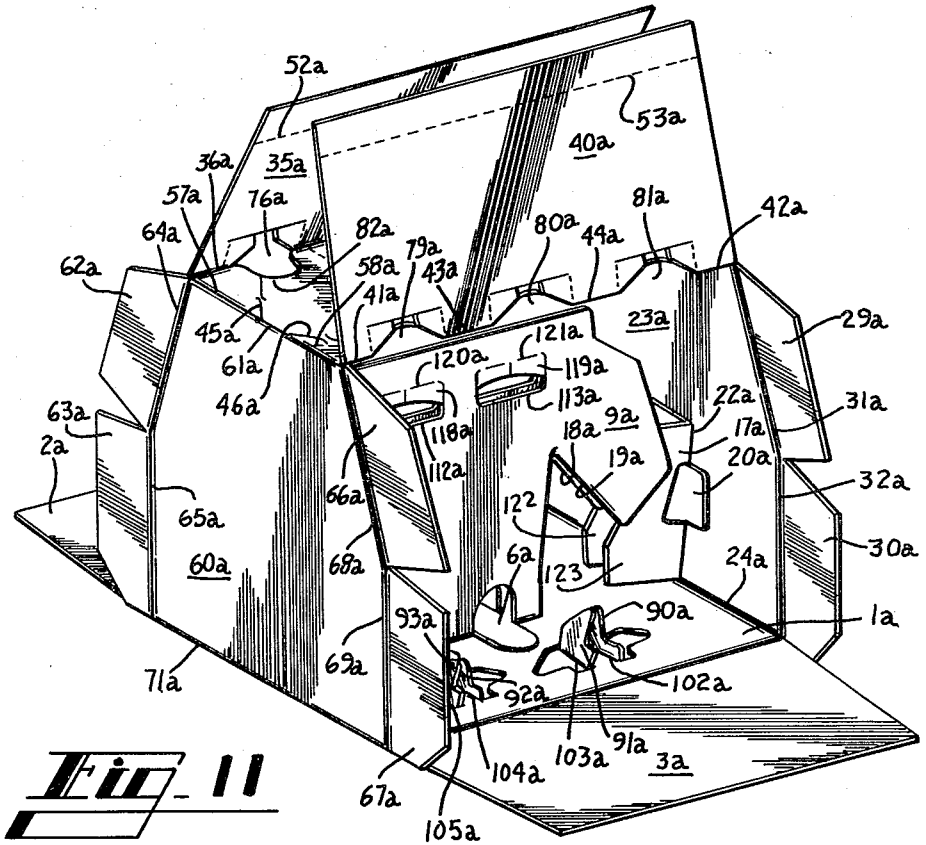
FIG. 11 is an isometric view of the modified form of the carrier in condition for loading articles therein.
Figure 10:
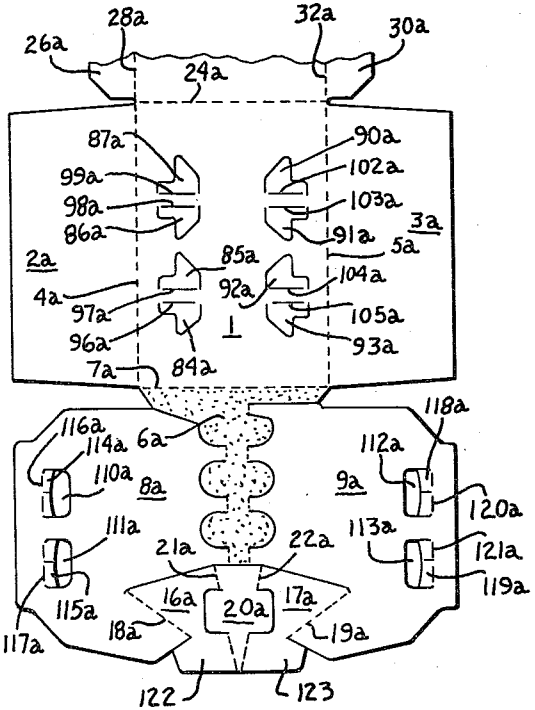
FIG. 10 is a plan view of a portion of the blank from which a modified version of this invention is formed.

A modification of this invention is depicted in FIGS. 10 and 11. Corresponding elements of the version of this invention shown in FIGS. 1–9 are identified in FIGS. 10 and 11 with the subscript "a". From FIG. 10 it is apparent that cushioning tabs 88, 89, 94 and 95 as shown in the blank of FIG. 3 are omitted. Also fastening tab 13 is omitted and supplementary bottom panel 6 is extended in order to provide a greater amount of material to be adhered to bottom wall 1. Additionally cushioning tabs 122 and 123 are integrally formed respectively along the lower portions of connecting panels 16 and 17. As shown in FIG. 11 cushioning tabs 122 and 123 in effect replace cushioning tabs 88 and 89 of the version of this invention shown in FIGS. 1–9.

Therefore by this invention a strong carrier is provided since handle panels 8 and 9 are directly secured to the carrier bottom and are secured to one of the carrier end walls by means of connecting panels 16 and 17 and anchoring tab 20. As a result any tendency for the handle structure to separate from the bottom wall is greatly reduced.

Also according to a feature of one form of this invention, in the completed carrier, spaced parallel fold lines 11 and 12 are disposed in coincidence respectively with spaced fold lines 106 and 107. Likewise spaced fold lines 14 and 15 re disposed respectively in coincidence with spaced fold lines 109 and 108. A double thickness of paperboard is provided at the various points of article contact and these spaced parallel fold lines facilitate manipulation and folding of cushioning tabs 94 and 95 at the points where the carrier paperboard is of double thickness and particularly difficult to bend.

INDUSTRIAL APPLICABILITY

By this invention an article carrier is provided which is strong and economical and is especially adapted for use in connection with returnable articles.

I claim:

1. An article carrier comprising a bottom wall, side wall means secured to the side edges of said bottom wall, a pair of end walls secured respectively to the ends of said bottom wall, a top panel secured to the upper edges of said side wall means and said end walls and disposed substantially parallel to said bottom wall, a supplementary bottom panel joined to said bottom wall, and handle means interconnected with said supplementary bottom panel and upstanding from said bottom wall, said handle means being interconnected with one of said end walls.

2. An article carrier according to claim 1 wherein said handle means comprises a pair of handle panels.

3. An article carrier according to claim 2 wherein said pair of handle panels are foldably joined respectively to a pair of connecting panels and wherein said connecting panels are secured to said one end wall and disposed in overlapping relationship respectively with said pair of handle panels.

4. An article carrier according to claim 3 wherein an anchoring tab is secured to said one end wall and wherein said pair of connecting panels are joined to said anchoring tab along the edges thereof remote from said pair of handle panels.

5. An article carrier according to claim 1 wherein said supplementary bottom panel is joined to an end edge of said bottom wall and secured in overlapping relationship with said bottom wall.

6. An article carrier according to claim 1 wherein said handle means is joined to said supplementary bottom panel by means of parallel spaced fold lines.

7. An article carrier according to claim 6 wherein a fastening tab is joined to said handle means by a pair of parallel spaced fold lines.

8. An article carrier according to claim 7 wherein a pair of cushioning tabs are each joined to said bottom wall by means of a pair of parallel spaced fold lines.

9. An article carrier according to claim 8 wherein said pairs of parallel fold lines associated with said bottom wall are disposed in coincidence with the corresponding pairs of parallel spaced fold lines associated with said handle means.

10. An article carrier comprising top, bottom, side and end walls interconnected to form an enclosure of generally cubical form wherein the improvement includes a supplementary bottom panel secured to the inside surface of said bottom wall in face contacting relation therewith, a medial partition forming handle panel foldably joined to said supplementary bottom panel and in substantially normal relation therewith, a connecting panel struck from and foldably joined to said handle panel, and an anchoring tab foldably joined to said connecting panel and secured in flat face contacting relation to the inside surface of one of said end walls at least a portion of said top wall being removable to afford access to said handle panel.

11. A carrier according to claim 10 wherein said connecting panel is disposed in flat face contacting relation to said handle panel.

12. A carrier according to claim 10 wherein said connecting panel is joined to said handle panel along a diagonal fold line and to said anchoring tab along a substantially vertical fold line.

13. An article carrier blank comprising a top panel, a pair of end walls foldably joined respectively to the end edges of said top panel, a bottom wall foldably joined to one of said end walls remote from said top panel, a supplementary bottom panel foldably joined to said bottom wall remote from said one end wall, handle means foldably joined to said secondary bottom panel, and a pair of connecting panels struck from said handle means and foldably joined thereto.

14. An article carrier blank according to claim 13 wherein a pair of upper side wall panels are foldably joined respectively to the side edges of said top panel and a pair of lower side wall panels are foldably joined respectively to the side edges of said bottom wall.

15. An article carrier blank according to claim 13 wherein at least one V-shaped bend line is formed in said top panel.

16. An article carrier blank according to claim 13 wherein an anchoring tab is struck from said handle means and interposed between and foldably joined to said connecting panels.

17. An article carrier blank according to claim 13 wherein a fastening tab is struck from said handle means and joined thereby by means of a pair of parallel spaced fold lines.

18. An article carrier blank according to claim 13 wherein said handle means comprises a pair of handle panels are wherein said connecting panels are struck respectively from said pair of handle panels.

19. An article carrier blank according to claim 18 wherein said connecting panels are joined respectively to said pair of handle panels by a pair of diagonal fold lines.

20. An article carrier blank according to claim 19 wherein an anchoring tab is interposed between said connecting panels and foldably joined thereto.

21. An article carrier according to claim 3 wherein a pair of cushioning tabs are integrally formed respectively along the lower portions of said pair of connecting panels.

22. An article carrier according to claim 10 wherein a cushioning tab is formed along the lower portion of said connecting panel.

23. An article carrier blank according to claim 13 wherein a pair of cushioning tabs are integrally joined respectivelyy to said pair of connecting panels.

* * * * *